US005334082A

United States Patent [19]

Barker

[11] Patent Number: 5,334,082

[45] Date of Patent: Aug. 2, 1994

[54] BRASSIERE WITH AUGMENTING BUST SUPPORT

[76] Inventor: Kathryn Z. Barker, 5615 Via DeCampo, Yorba Linda, Calif. 92687-4917

[21] Appl. No.: 42,618

[22] Filed: Apr. 2, 1993

[51] Int. Cl.[5] ..... A41C 3/14

[52] U.S. Cl. ..... 450/31; 450/32; 450/54; 450/55; 450/56; 2/247; 2/267

[58] Field of Search ..... 2/67, 73, 247, 267, 2/268; 450/31, 32, 36, 37, 52, 53, 54, 55, 56, 57, 61, 89

[56] References Cited

U.S. PATENT DOCUMENTS

| | | | |
|---|---|---|---|
| 1,059,167 | 4/1913 | Kniseley | 2/267 X |
| 1,845,011 | 2/1932 | Yerkes | 2/267 |
| 2,359,804 | 10/1944 | Struthers | 2/67 |
| 2,567,732 | 9/1951 | Rosenthal | 450/54 |
| 3,099,839 | 8/1963 | Kester | 450/55 X |

FOREIGN PATENT DOCUMENTS

| | | | |
|---|---|---|---|
| 0151623 | 10/1951 | Australia | 450/86 |
| 070656 | 6/1959 | France | 450/57 |
| 0271095 | 1/1951 | Switzerland | 450/56 |

*Primary Examiner*—Clifford D. Crowder
*Assistant Examiner*—Jeanette E. Chapman
*Attorney, Agent, or Firm*—Walter A. Hackler

[57] ABSTRACT

An improved brassiere includes a pair of fabric breast cups and straps, interconnecting said breast cups and maintaining a spaced apart relationship therebetween, for enabling the breast cups to be worn by a user. Breast pillows are provided for augmenting and uplifting a user's breasts with the breast pillows being formed from a breast implant type gel for simulating breast tissue of the user. The gel is a washable fabric and has a crescent shape with a generally flat top portion sized for uplifting the user's breasts. A pocket in a lower half of each breast cup is provided for receiving the breast pillows. The pockets are sized and positioned, in the breast cups, in order to enable the flat top portions, of the breast pillows, to engage an underside of each of the user's breasts for uplifting thereof. The straps and the breast cups are sized for enabling the uplifted breasts to exert downward and outward pressure on said breast pillows, causing the breast pillows to conform with, augment and simulate the undersides of the user's breasts.

1 Claim, 1 Drawing Sheet

BRASSIERE WITH AUGMENTING BUST SUPPORT

The present invention generally relates to women's support garments and is more particularly directed to an improved brassiere and brassiere ensemble which provides augmenting breast support.

A great number of women desire an enhancement to their breasts, and many have turned to the use of surgically implanted gel systems. It has been recently reported, however, that a number of problems arise with the use of breast implants which include not only rejection by the body, but failure of the implant to remain structurally sound. That is, some implants have been found to break up and migrate to undesirable locations within the user's body.

By avoiding such implants, women desiring breast enhancement, such an increase in volume of the breasts themselves and an enhancement of the cleavage between the breasts, have no viable alternative for a way to substantially duplicate the feel of breasts.

Heretofore, in the development of supporting brassieres, the prior art has utilized a number of padded breast cups. Typical padding heretofore used has been cloth or polyester, as well as many types of silicone gels which may have little or no resiliency or do not provide the feel of real breasts.

Many padded bras have utilized fixed pads within the breast cups and others have utilized pockets in each cup for receiving a pad insert.

The present invention provides a brassiere which augments the bust and provides for a real-like expansion of the bust through the use of the same type of material utilized for breast implants. It is apparent that the consistency of the implanted gels, which are utilized in the present invention, closely matches the consistency of breast tissue, to the point where casual touching of the breast will not disclose the gel.

SUMMARY OF THE INVENTION

A brassiere in accordance with the present invention generally includes a pair of fabric breast cups and strap means interconnecting the breast cups and maintaining them in a spaced apart relationship therebetween, for enabling the breast cups to be worn by a user.

Importantly, breast pillow means are provided for augmenting and uplifting a user's breasts and the breast pillow means in accordance with the present invention utilize implant type gels which provide a means for simulating the breast tissue of the user.

More particularly, in accordance with the present invention, the gel is disposed in a sealed, pliable pouch covered with a washable fabric, which enables periodic cleaning thereof without degradation of the gel. This has significant advantage over the prior art systems utilizing cotton, foam or polyester type materials, which may disintegrate or harden during repeated use and/or washing.

The breast pillow means in accordance with the present invention are generally crescent shaped, with a generally flat portion thereon, sized for uplifting the user's breasts.

A pocket disposed in the lower half of each breast cup provides a means for receiving the breast pillow means and, advantageously, the breast pillow means are interchangeable with one another in the pockets. The pockets are sized and positioned in the breast cups in order to enable the flat top portions of the breast pillow means to engage an underside of each of the user's breasts for uplifting thereof. Further, strap means are sized for enabling the uplifted breast to exert downward and outward pressure on the breast pillow means, with the breast implant gel means therein, to conform with, augment and simulate the undersides of the user's breasts.

More particularly, in accordance with the present invention, the pocket comprises a liner fixed with bottom edge of each fabric breast cup and pairs of overlapping flaps, one of each flat pair being attached to each fabric breast cup and another each flat pair as being attached to a top of the liner. This structure facilitates easy access to the pocket for insertion of the breast pillow means and the overlapping configuration of the flaps ensures positive placement of the breast pillow means within the pocket when the user wears the brassiere. Since no snaps, seams or other closure device is utilized, a smooth comfortable fit between the breast and the breast pillow means is provided.

In one embodiment of the present invention, the brassiere further includes support means, disposed along a bottom edge of each fabric breast cup, for limiting downward movement of the breast pillow means. The support means may comprise an elastic band which would be most suitable for athletic of sports-type brassieres, or a rigid arcuate member which would be more suitable for a brassiere in accordance with the present invention for use with formal wear.

The breast pillow means in accordance with the present invention may alternatively include a plurality of pairs of sealed pliable pouches, each being filled with the implant-type gel means, with each pair being of a different size from another pair. This feature enables the user to obtain breast enhancement of varying degrees.

As hereinabove noted, brassieres in accordance with the present invention may be utilized for garments designed for a wide variety of activities. In that regard, a further embodiment of the present invention includes a brassiere ensemble which includes a plurality of brassiere shells which may be of various sizes, shapes, colors and configurations, particularly adapted for a particular use, such as but not limited to, sports activities, including swimming, general every day use, and formal attire.

Each of the brassiere shells include a pair of fabric cups and strap means interconnecting the breast cups and maintaining a spaced apart relationship therebetween for enabling the breast cups to be worn by the user.

Means, defining a pocket in a lower half of each breast cup, are provided for receiving breast pillow means. Importantly, the breast pillow means are interchangeable and receivable by any of the plurality of the brassiere shells. Thus, the breast pillow means provided for in accordance with the present invention, for augmenting and uplifting a user's breast, may be utilized in combination with a variety of brassiere shell configurations.

BRIEF DESCRIPTION OF THE DRAWINGS

The present invention may be more clearly appreciated when taken in conjunction with the accompanying drawings, in which.

DETAILED DESCRIPTION

Figure 1:
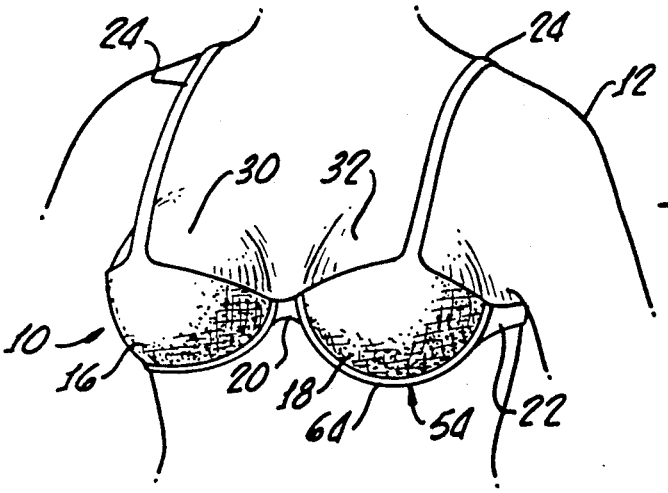
FIG. 1 is a perspective view of a brassiere in accordance with the present invention as may be worn by a user.

Turning now to FIG. 1, where there is shown a brassiere 10 in accordance with the present invention, as it may be worn by a user 12. It should be appreciated that the brassiere 10 shown in FIG. 1 is only representative of a plurality of brassieres which, together, provide a brassiere ensemble for the user 12, suitable for use during all activities of the user 12 and various outer garments (not shown).

The brassiere 10 includes a pair of fabric breast cups 16–18.

A center strap 20 and side straps 22 along with shoulder straps 24, provide a means for interconnecting the breast cups 16, 18, and maintaining them in a spaced apart relationship, while enabling the breast cups 16, 18 to be worn by the user 12 in a conventional manner.

Figure 2:
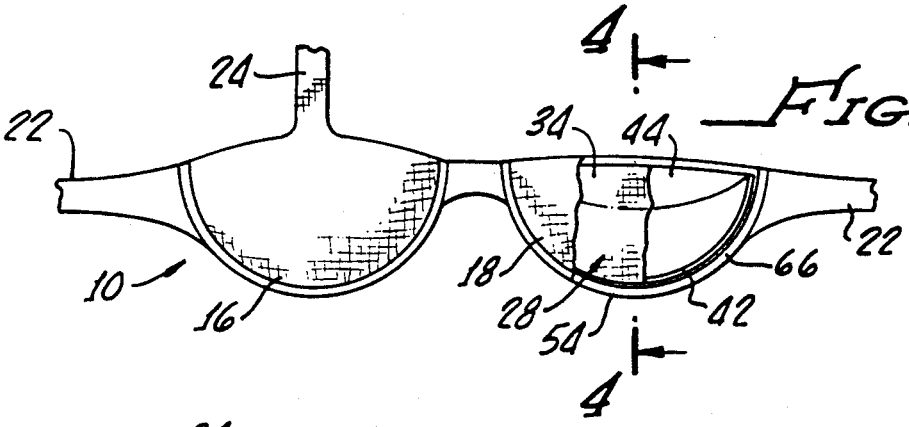
FIG. 2 is a front view of a brassiere in accordance with the present invention, partially broken away in order to show a breast pillow disposed therein.
Figure 3:
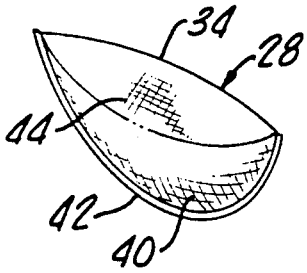
FIG. 3 is a perspective view of a breast pillow in accordance with the present invention.

As shown in the broken away view of FIG. 2 and the perspective view of FIG. 3, breast pillows 28 provide a means for augmenting and uplifting a user's breasts 30, 32 as will be hereinafter described in greater detail.

More particularly, the breast pillows 28 comprise a pliable pouch 34 for containing a breast implant type of gel 38. The pouch 34 may be formed from any suitable thin pliable plastic-like material which will not inhibit the resiliency or feel of the breast implant type gel 38. Suitable implant type gels are available from Dow Corning and include dielectric gels such as No. 527, or Q-272218 gel, which has a consistency equivalent to implantable gels.

The pouch 34 is covered by a washable fabric 40, naturally, the fabric 40 must be selected to sufficiently sheer so as not to inhibit the tissue-like resiliency of the gel 38. In addition, it is preferable that the pouch 34 is properly sealed and sufficiently strong to enable the breast pillows 28 to be washed, thus enabling use over prolonged periods of time.

Turning again to FIG. 3, the breast pillows 28 are generally crescent shaped, having a generally arcuate bottom 42, with a generally tapered top portion 44 for uplifting the user's breasts 30, 32.

Figure 4:
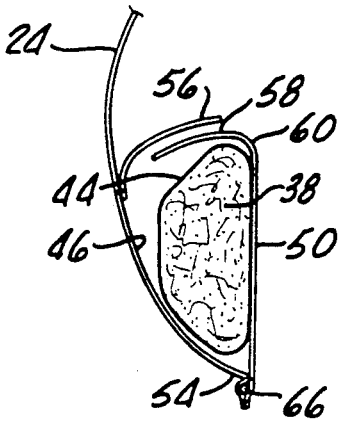
FIG. 4 is a cross sectional view of the breast pillow in accordance with the present invention disposed within a pocket in the brassiere, with overlying flaps for holding the breast pillows within the pocket when the brassiere is not in use.

As best shown in FIG. 4, the breast pillows 28 are retained within the breast cup 16, 18 by means of a pocket 46 defined in a lower half.

The pocket 46 includes a liner 50, attached to a bottom edge 54 of the breast cups 16, 18 and a pair of overlapping flaps 56, 58, with flap 56 being attached to the breast cup 16, 18 and the flap 58 attached to a top 60 of the liner 50. The flap 58 and liner 50 may be formed from a single piece of material, but it is important that no seams or attachment mechanisms be present which may disturb the contact between the breast pillow top 44 and an underside of the breast 32 (see FIG. 5) which may cause discomfort or interrupt with the confirmation of the breast pillow 28 with the breast 32.

Figure 5:
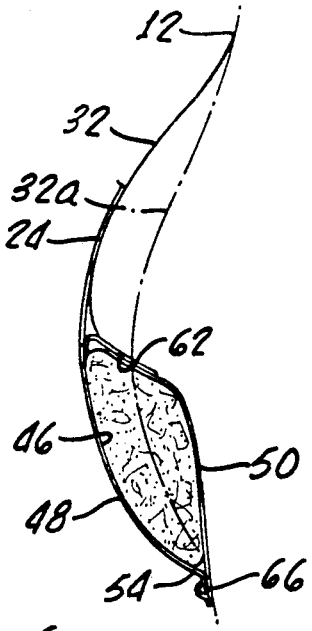
FIG. 5 is a view taken along the line 5—5 in FIG. 2 showing the effect of the brassiere in accordance with the present invention, uplifting a user's breast, and also in phantom line a representation of the breast without the supporting features of the present invention.

The pocket 46 and the straps 20, 22, 24 are sized and positioned to enable the tapered top of 44 of the breast pillow 28 to engage the underside 62 of the user's breast 32. (See FIG. 5). The tapered top 44 provides a breast enhancing engagement between the breast pillow 28 and the underside 62. This configuration coupled with the use of the bust implant type gel 38 permits a unique support and enhancement for the user's breasts 30, 32. In combination therewith, the breast cups 16 18 are sized for enabling the uplifted breasts 32 to exert downward and outward pressure on the breast pillows 28, causing the breast pillows 28 to conform with augment and simulate the underside of the user's breast. This is shown in solid line of FIG. 5. A representation of the breast 32*a* is also shown in FIG. 5, without the brassiere 10 in accordance with the present invention in place.

It should be appreciated that the breast pillows 28 may be made in various sizes and, of course, are interchangeable within the breast cups 16, 18.

Depending upon the intended use of the bra, a support 64 may be disposed along the bottom 54 of each breast cup 16, 18 for limiting downward movement of the breast pillows 28. Again, depending upon the intended use for the brassiere 10, the support 64 may be an elastic band for athletic use or, as shown in FIG. 4, may comprise a rigid arcuate member, such as a wire 66, for formal attire.

In that regard, the present invention encompasses a brassiere ensemble which includes a plurality of brassiere shells, including breast cups 16, 18 and straps 20, 22 and 24 of various configurations, shapes, sizes and of different materials, each including pouches 34 for supporting the breast pillows 28. The breast pillows 28 are interchangeable in any of the breast cups 16, 18, thus enabling a single set of breast pillows 28 to be used with a great number of bras. Also, in that regard, the breast pillows 28 may be sized with increasing volume in order that the user may select different breast enhancement for different occasions.

Although there has been hereinabove described specific arrangements of a brassiere with augmenting bust support, in accordance with the invention, for the purpose of illustrating the manner in which the invention may be used to advantage, it will be appreciated that the invention is not limited thereto. Accordingly, any and all modification, variations, or equivalent arrangements which may occur to those skilled in the art should be considered to be within the scope of the invention as defined in the appended claims.

What is claimed is:

1. A brassiere ensemble comprising:

a plurality of brassiere shells, each shell comprising:

a pair of fabric breast cups;

strap means, interconnecting said breast cups and maintaining a spaced apart relationship therebetween, for enabling the breast cups to be worn by a user;

means, defining a pocket in a lower half of each breast cup, for receiving breast pillow means, said breast pillow means being interchangeable and receivable by any of the plurality of brassiere shells, the pocket defining mans being sized and positioned, in said breast cups, in order to enable a tapered top position of the breast pillow means to engage an underside of each of the user's breasts for uplifting thereof, said strap means and said breast cups being sized for enabling uplifted breasts to exert downward and outward pressure on said breast pillow means to conform with, augment and simulate the undersides of the user's breasts, said pocket defining means further comprising a liner fixed to a bottom edge of each fabric breast cup and pairs of overlapping flaps, one of each flap pair being attached o each fabric breast cup and another of each flap pair being attached to a top of the liner, said flap being positioned in order that the underside of the user's breasts provide compression to hold the flaps against one another and against the breast pillow means;

breast pillow means for augmenting and uplifting a user's breasts, said breast pillow means being receivable by any of the plurality of brassiere shells and comprising breast implant type gel means for simulating breast tissue of the user, the breast pillow means further comprising sealed pliable pouch means for containing the gel means, and a washable fabric covering the pliable pouch means, said breast pillow means being crescent shaped with a tapered top portion; and support means, disposed along the bottom edge of each fabric breast cup, for limiting downward movement of the breast pillow means.

* * * * *